US009758974B1

(12) United States Patent
Reeves

(10) Patent No.: US 9,758,974 B1
(45) Date of Patent: Sep. 12, 2017

(54) SHEETROCK LIFTING DEVICE

(71) Applicant: Dewell Reeves, Waynesville, MO (US)

(72) Inventor: Dewell Reeves, Waynesville, MO (US)

( * ) Notice: Subject to any disclaimer, the term of this patent is extended or adjusted under 35 U.S.C. 154(b) by 0 days.

(21) Appl. No.: 15/178,317

(22) Filed: Jun. 9, 2016

(51) Int. Cl.
*E04G 21/14* (2006.01)
*E04F 21/18* (2006.01)

(52) U.S. Cl.
CPC ..... *E04F 21/1805* (2013.01); *E04F 21/1811* (2013.01); *E04F 21/1822* (2013.01)

(58) Field of Classification Search
CPC ..... E04F 21/1805; E04F 21/1811; E04F 21/1822
USPC ..... 414/11
See application file for complete search history.

(56) References Cited

U.S. PATENT DOCUMENTS 4,120,484 A 10/1978 Zimmer
4,300,751 A * 11/1981 Delaney ..... B66C 23/48 254/2 R
5,700,123 A * 12/1997 Rokosh ..... E04F 21/1811 414/11
7,387,293 B2 6/2008 Boucher
8,708,350 B2 4/2014 Bottazzi
9,334,663 B2 * 5/2016 Galvez ..... E04F 21/1811
2003/0127834 A1 * 7/2003 Click ..... B62B 3/108 280/651
2006/0062655 A1 * 3/2006 Harrelson ..... B66F 9/065 414/10
2007/0104558 A1 * 5/2007 Narelli ..... E04F 21/1822 414/11
2008/0008561 A1 * 1/2008 Hontz ..... E04F 21/1822 414/11

FOREIGN PATENT DOCUMENTS

GB 2161139 A * 1/1986 ..... E04F 21/1805
GB 2367326 A * 4/2002 ..... E04F 21/1805
WO WO 2014172084 A1 * 10/2014 ..... B66C 23/48

* cited by examiner

*Primary Examiner* — Rakesh Kumar
(74) *Attorney, Agent, or Firm* — Stevenson IP, LLC

(57) ABSTRACT

A sheetrock lifting device including a base with a protrusion centrally disposed on a front side of the base. A plurality of locking caster wheels is disposed on the base and on the protrusion. A pair of stanchions is used to house a battery and a manual wench. A pair of support rods supports the device by connecting the stanchions to the protrusion. A pair of stabilizing beams further supports the stanchions. A pulley device containing a pulley arm, pulley, and pulley cable is disposed on the stabilizing beams. An electric wench is disposed between the stabilizing beams and is in operational communication the battery. The electric wench raises and lowers a telescoping tube to which is attached a drywall frame. A manual wench alternately raises and lowers the telescoping tube with a cable hook connected to a ring on the telescoping tube.

2 Claims, 5 Drawing Sheets

SHEETROCK LIFTING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of height adjustable sheetrock lifting devices are known in the prior art. However, what is needed and what the present device provides is a sheetrock lifting device with a telescoping tube which is extended and retracted with either a battery operated winch or a manual winch, each having a respective pulley mechanism. The sheetrock lifting device should also include a drywall frame attached to the telescoping tube to secure a panel of drywall to be lifted or lowered by the device. The device should have extra support provided by a pair of support rods and a pair of stabilizing beams.

FIELD OF THE INVENTION

The present invention relates to a height adjustable drywall device, and more particularly, to a sheetrock lifting device which is electrically and alternately manually operational.

SUMMARY OF THE INVENTION

The general purpose of the present sheetrock lifting device, described subsequently in greater detail, is to provide a sheetrock lifting device which has many novel features that result in a sheetrock lifting device which is not anticipated, rendered obvious, suggested, or even implied by prior art, either alone or in combination thereof.

To accomplish this, the present sheetrock lifting device provides both electrical and manual operations. The instant device includes a parallelepiped wheeled base with a parallelepiped protrusion centrally disposed on a front side thereof and coplanar with the base. The protrusion has a width smaller than a width of the base thereof. A pair of parallelepiped stanchions is disposed on a top side of the base proximal a rear side thereof. Each of the pair of stanchions has an upper wall, a lower wall, a rearward wall, a forward wall, and an interior wall. A pair of support rods connects a top wall of the protrusion with the interior walls of the stanchions to add extra support for the device. A pair of parallelepiped stabilizing beams is centrally disposed in a position parallel to each other on the base top side between the stanchions. The pair of stabilizing beams has an internal wall and a height greater than a height of the stanchions. A cylindrical telescoping tube is centrally disposed on the top side of the base between the stabilizing beams. The telescoping tube has a ring disposed on an upper portion thereof.

A U-shaped pulley arm is disposed on a top section of the stabilizing beams with a pulley being disposed on an outer end of the pulley arm. An electric winch is disposed on the internal walls of the pair of stabilizing beams proximal the upper walls. The electric winch comprises a battery which is disposed within one of the pair of stanchions and is in operational communication with an on-off switch disposed on the stanchion proximal the electric winch. The engagement of the electric winch is configured to lower and alternately raise the telescoping tube. A pulley cable extends from the ring to the electric winch and is rotationally engagable with the pulley.

An I-shaped drywall frame has a parallelepiped crossmember with an outer edge and an inner edge. An attachment piece attaches the crossmember to the telescoping tube. A parallelepiped end member is disposed on each of an external end of the crossmember. A plurality of vertically disposed nails is on each of the end members.

The present device also includes a manual disposed on the upper wall of the stanchion opposite the stanchion housing the battery. The manual winch comprises a cable with an outer end to which a cable hook is disposed. The cable hook is engageable to the ring. The rotation of the manual winch is configured to raise and alternately lower the telescoping tube.

Thus has been broadly outlined the more important features of the present sheetrock lifting device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
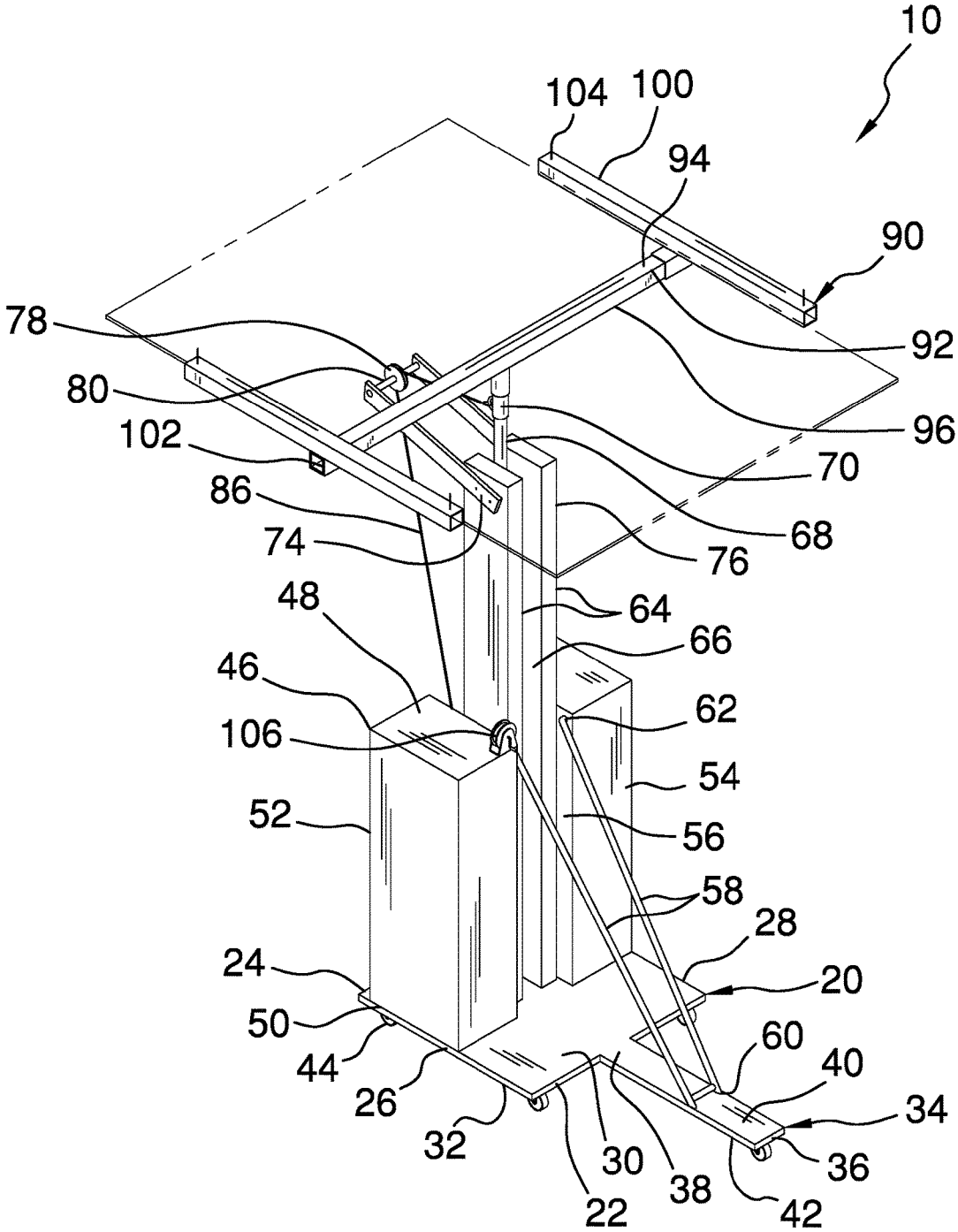
FIG. 1 is an isometric view.
Figure 2:
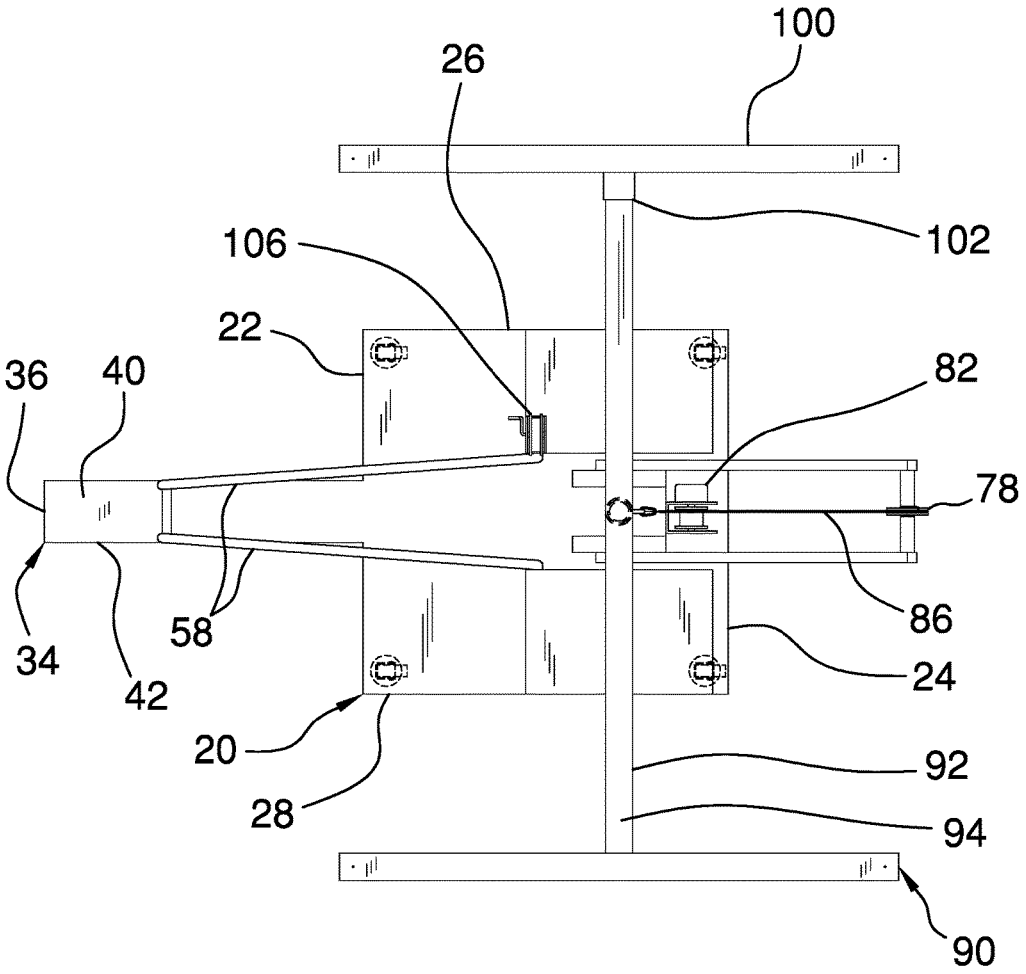
FIG. 2 is a top plan view.
Figure 3:
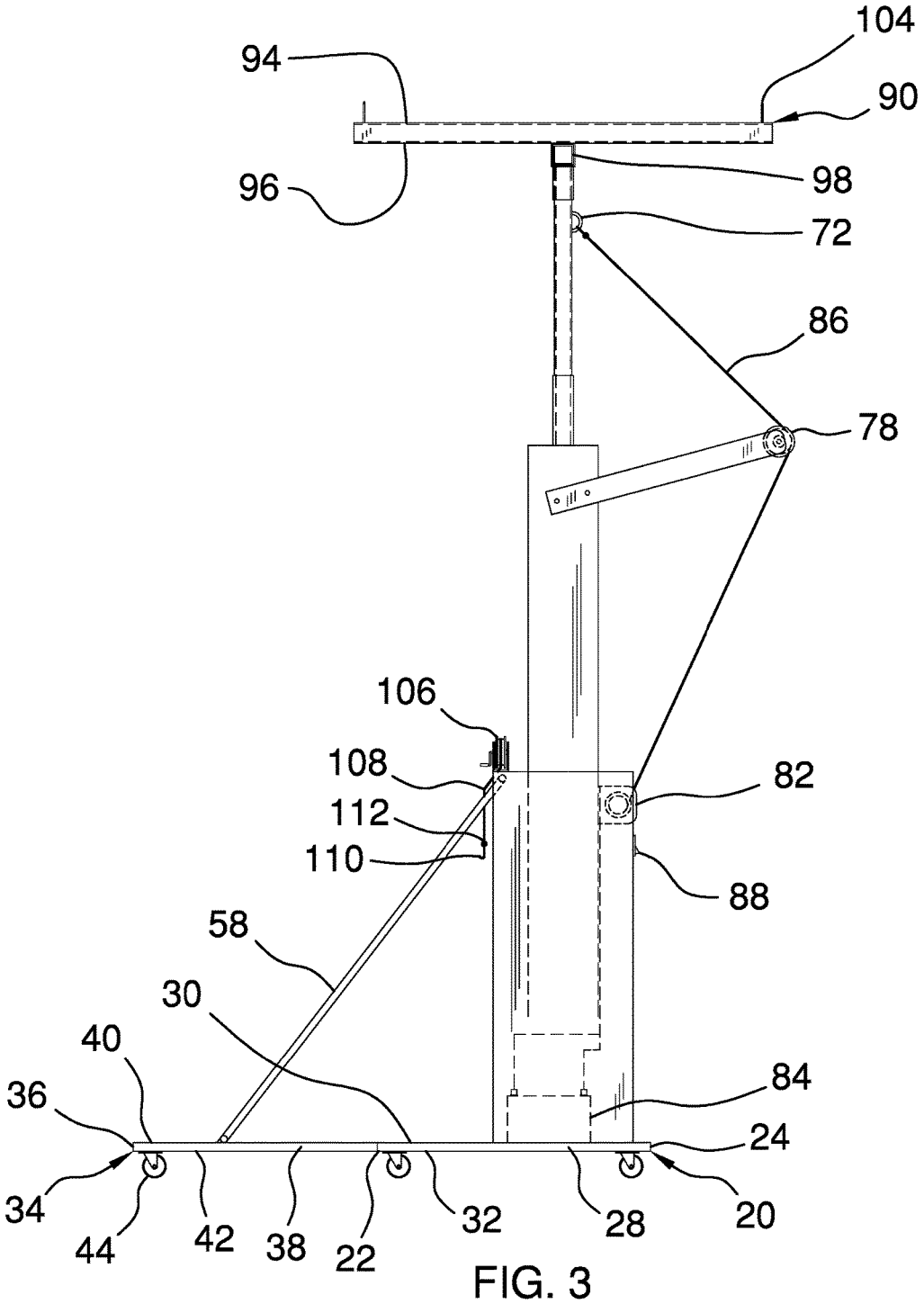
FIG. 3 is a left side elevation view.
Figure 4:
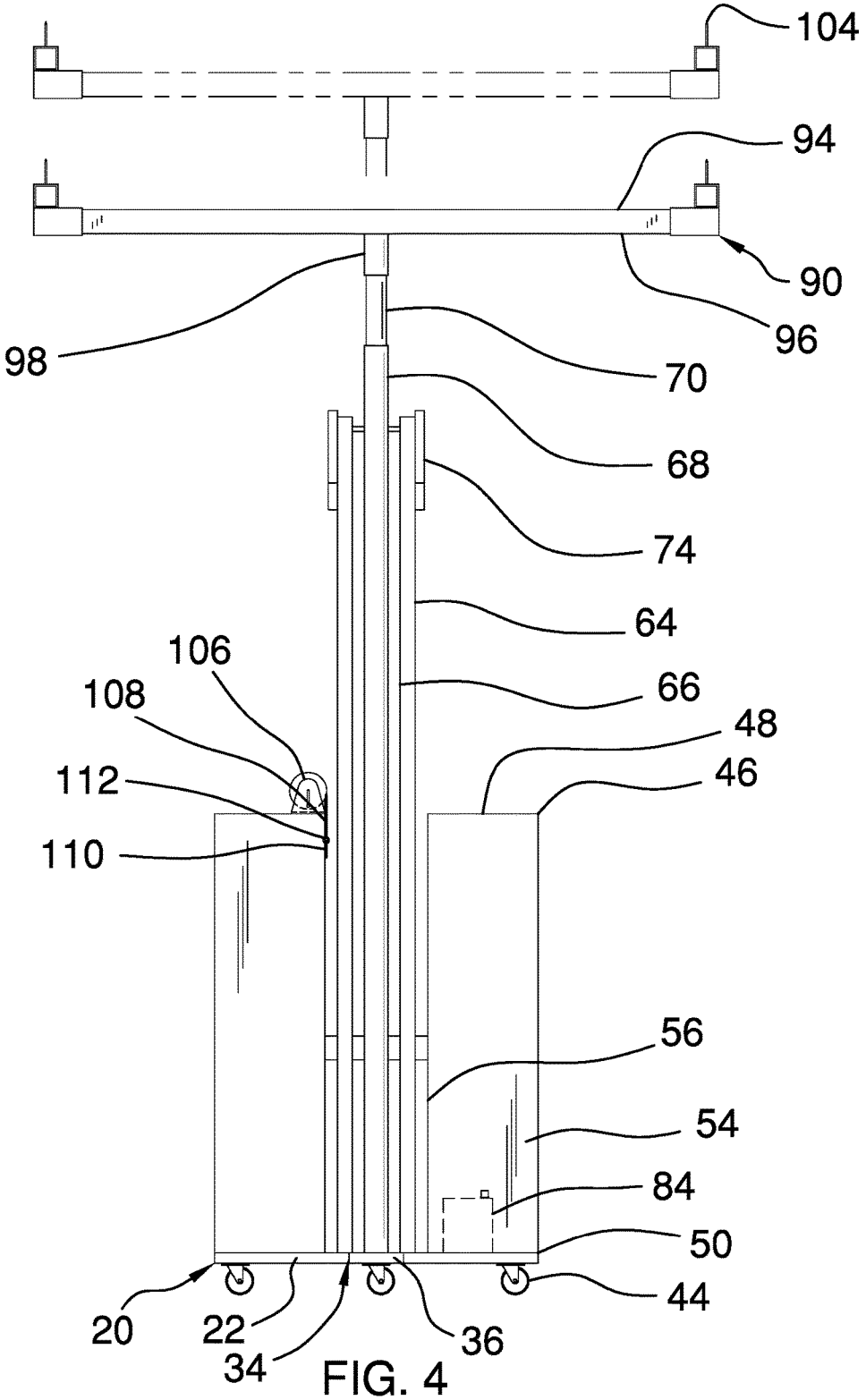
FIG. 4 is a front elevation view.
Figure 5:
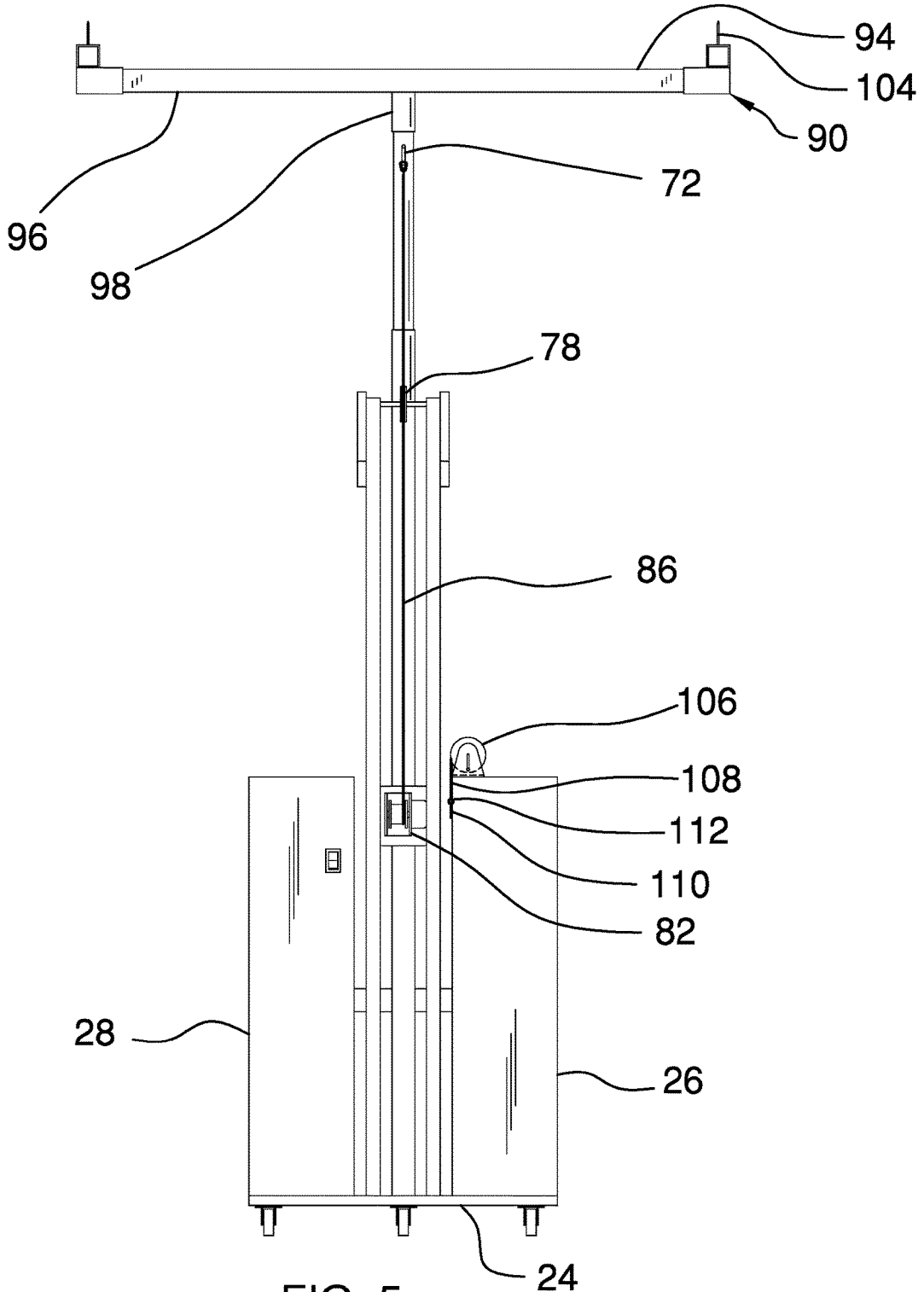
FIG. 5 is a rear elevation view.

With reference now to the drawings, and in particular FIGS. 1 through 5 thereof, an example of the instant sheetrock lifting device employing the principles and concepts of the present sheetrock lifting device and generally designated by the reference number 10 will be described.

Referring to FIGS. 1 through 5 the present sheetrock lifting device 10 is illustrated. The sheetrock lifting device 10 includes a parallelepiped base 20. The base 20 has a front side 22, rear side 24, left side 26, right side 28, a top side 30, a bottom side 32, and a parallelepiped protrusion 34 centrally disposed on the front side 22. The protrusion 34 has a front portion 36, a rear portion 38 attached to the base 20, a top wall 40, and a bottom wall 42. The protrusion 34 is coplanar with the base and further has a width smaller than a width of the base thereof. A plurality of locking caster wheels 44 is disposed on each of the bottom side 32 of the base 10 and the bottom wall 42 of the protrusion 34 proximal the front portion 36.

A pair of parallelepiped stanchions 46 are disposed on the top side 30 proximal the rear side 24 in a position parallel to each other and proximal the respective right side 26 and left side 28. Each of the pair of stanchions 46 has an upper wall 48, a lower wall 50, a rearward wall 52, a forward wall 54, and an interior wall 56. A pair of support rods 58, each rod 58 has a first end 60 centrally disposed on the top wall 40 and a second end 62 disposed on the interior wall 56 proximal the upper wall 48 of the respective stanchion 52.

A pair of parallelepiped stabilizing beams 64 is centrally disposed in a position parallel to each other on the top side 30 between the pair of stanchions 52. The pair of stabilizing beams 64 has an internal wall 66 and a height greater than a height of the stanchions 52.

A cylindrical telescoping tube 68 is centrally disposed on the top side 30 of the base 20 between the pair of stabilizing beams 64 in a position parallel to the stabilizing beams 64. The telescoping tube 68 has an upper portion 70. A ring 72 is disposed on the upper portion 70 in a position parallel to the upper portion 70.

A U-shaped pulley arm 74 is disposed on a top section 76 of the stabilizing beams 64 in a position substantially perpendicular to the stabilizing beams 64. A pulley 78 is disposed on an outer end 80 of the pulley arm 74. An electric winch 82 is disposed on the internal walls 66 of the pair of stabilizing beams 64 proximal the upper walls 48 of the stanchions 46 on a same side of the stabilizing beams 64 as the pulley arm 74. The electric winch 82 comprises a battery 84 which is disposed within one of the pair of stanchions 46. The battery 84 is in operational communication with the electric winch 82. The engagement of the electric winch 82 is configured to lower and alternately raise the telescoping tube 68. A pulley cable 86 is rotationally engagable with the pulley 78. The pulley cable 86 extends from the ring 72 to the electric winch 82. An on-off switch 88 is in operation communication with the battery 84 and is disposed on the respective stanchion 46 proximal the electric winch 82.

An I-shaped drywall frame 90 has a parallelepiped crossmember 92. The crossmember has an outer edge 94 and an inner edge 96. An attachment piece 98 is centrally and vertically disposed on the inner edge 96, wherein the attachment piece 98 engages the upper portion 70 of the telescoping tube 68. A parallelepiped end member 100 is disposed on each of an external end 102 of the crossmember. A plurality of vertically disposed nails 104 is on each of the end members 100.

A manual winch 106 is disposed on the upper wall 48 of the stanchion 46 opposite the stanchion 46 housing the battery 84. The manual winch 106 comprises a cable 108. A cable hook 110 is disposed on an outer end of the cable 112, and the cable hook 110 is engageable to the ring 72. The rotation of the manual winch 106 is configured to raise and alternately lower the telescoping tube 68.

What is claimed is:

1. A sheetrock lifting device comprising:

a parallelepiped base having a front side, rear side, left side, right side, a top side, a bottom side, and a parallelepiped protrusion centrally disposed on the front side, the protrusion having a front portion, a rear portion, a top wall, and a bottom wall, wherein the protrusion is attached to the base at the rear portion, the protrusion being coplanar with the base and having a width less than a width of the base thereof;

a plurality of locking caster wheels disposed on each of the bottom side of the base and the bottom wall of the protrusion proximal the front portion;

a pair of parallelepiped stanchions disposed on the top side proximal the rear side in a position parallel to each other and proximal the respective right side and left side, each of the pair of stanchions having an upper wall, a lower wall, a rearward wall, a forward wall, and an interior wall;

a pair of support rods, each rod having a first end centrally disposed on the top wall and a second end disposed on the interior wall proximal the upper wall of the respective stanchion;

a pair of parallelepiped stabilizing beams centrally disposed in a position parallel to each other on the top side between the pair of stanchions, the pair of stabilizing beams having an internal wall and a height greater than a height of the stanchions;

a cylindrical telescoping tube centrally disposed on the top side of the base between the pair of stabilizing beams in a position parallel to the stabilizing beams, the telescoping tube having an upper portion and a ring disposed on the upper portion in a position parallel to the upper portion;

a U-shaped pulley arm disposed on a top section of the stabilizing beams in a position substantially perpendicular to the stabilizing beams;

a pulley disposed on an outer end of the pulley arm;

an electric winch disposed on the internal walls of the pair of stabilizing beams proximal the upper walls of the stanchions on a same side of the stabilizing beams as the pulley arm, the electric winch comprising a battery disposed within one of the pair of stanchions, wherein the battery is in operational communication with the electric winch, wherein the engagement of the electric winch is configured to lower and alternately raise the telescoping tube;

a pulley cable rotationally engaging the pulley, the pulley cable extending from the ring to the electric winch;

an on-off switch disposed on the respective stanchion proximal the electric winch; and an I-shaped drywall frame having a parallelepiped crossmember having an outer edge and an inner edge, an attachment piece centrally and vertically disposed on the inner edge, wherein the attachment piece engages the upper portion of the telescoping tube, a parallelepiped end member disposed on each of an external end of the crossmember, and a plurality of vertically disposed nails on each of the end members.

2. The sheetrock lifting device of claim 1 further comprising a manual winch disposed on the upper wall of the stanchion opposite the stanchion housing the battery, the manual winch comprising:

a cable; and a cable hook disposed on an outer end of the cable, the cable hook engageable to the ring, wherein the rotation of the manual winch is configured to raise and alternately lower the telescoping tube.

* * * * *